US006684740B2

(12) United States Patent
Lin

(10) Patent No.: US 6,684,740 B2
(45) Date of Patent: Feb. 3, 2004

(54) MAGNETIC DEVICE FOR RETAINING TOOL MEMBERS TO DRIVERS

(76) Inventor: Ching Chou Lin, P.O. Box 63-99, Taichung 406 (TW)

( * ) Notice: Subject to any disclaimer, the term of this patent is extended or adjusted under 35 U.S.C. 154(b) by 0 days.

(21) Appl. No.: 10/135,124

(22) Filed: Apr. 26, 2002

(65) Prior Publication Data

US 2003/0200843 A1 Oct. 30, 2003

(51) Int. Cl.[7] ..... B25B 23/00
(52) U.S. Cl. ..... 81/438; 81/177.2
(58) Field of Search ..... 81/438, 439, 64, 81/177.2, 185.2

(56) References Cited

U.S. PATENT DOCUMENTS

| | | | | | |
|---|---|---|---|---|---|
| 3,630,108 | A | * | 12/1971 | Stillwagon, Jr. | 81/125 |
| 3,707,894 | A | * | 1/1973 | Stillwagon, Jr. | 81/125 |
| 4,299,021 | A | * | 11/1981 | Williams | 29/432 |
| 4,703,677 | A | * | 11/1987 | Rossini | 81/471 |
| 4,876,929 | A | | 10/1989 | Kozak | 81/57.43 |
| 4,924,733 | A | * | 5/1990 | McKenzie | 81/438 |
| 5,163,345 | A | * | 11/1992 | Doan et al. | 81/125 |
| 5,182,973 | A | * | 2/1993 | Martindell | 81/429 |
| 5,195,761 | A | * | 3/1993 | Eimer | 279/90 |
| 5,400,681 | A | * | 3/1995 | Strauch | 81/177.2 |
| 5,732,606 | A | | 3/1998 | Chiang | 81/177.2 |
| 5,916,341 | A | * | 6/1999 | Lin | 81/437 |
| 5,934,384 | A | * | 8/1999 | Wang | 173/132 |
| 6,058,812 | A | | 5/2000 | Casel et al. | 81/60 |
| 6,134,995 | A | * | 10/2000 | Shiao | 81/439 |
| 6,173,467 | B1 | * | 1/2001 | Chou | 7/165 |
| 6,179,532 | B1 | * | 1/2001 | Oldham | 409/132 |
| 6,209,426 | B1 | * | 4/2001 | Takahashi | 81/451 |
| 6,345,560 | B1 | * | 2/2002 | Strauch et al. | 81/477 |
| 6,370,993 | B1 | * | 4/2002 | Pitstick | 81/463 |
| 6,397,705 | B1 | * | 6/2002 | Hsieh | 81/63.1 |
| 6,412,373 | B1 | * | 7/2002 | Hsiao | 81/177.7 |
| 6,488,452 | B1 | * | 12/2002 | Hoskins et al. | 408/239 R |
| 6,520,509 | B1 | * | 2/2003 | Vasudeva et al. | 279/145 |
| 6,524,035 | B1 | * | 2/2003 | Robison | 408/211 |
| 6,530,299 | B1 | * | 3/2003 | Liu | 81/451 |

FOREIGN PATENT DOCUMENTS

| | | | | |
|---|---|---|---|---|
| EP | 75330 A2 | * | 6/1983 | B25C/3/00 |
| FR | 2652027 A1 | * | 3/1991 | B25B/23/12 |

* cited by examiner

*Primary Examiner*—Joseph J. Hail, III
*Assistant Examiner*—David B. Thomas

(57) ABSTRACT

A magnetic retaining device includes a barrel secured to one end of a flexible extension shaft or a driving shank, a pole slidably received in the barrel and having one end extendible outward of the barrel, a magnetic member secured to the outer end of the pole, and a retaining ring may be attached to the pole for limiting a movement of the pole relative to the barrel. The pole and the magnetic member may thus be moved relative to the barrel and may be moved inward and outward of the barrel, for attracting or driving the tool members in the deep grooves of the objects.

4 Claims, 6 Drawing Sheets

MAGNETIC DEVICE FOR RETAINING TOOL MEMBERS TO DRIVERS

BACKGROUND OF THE INVENTION

1. Field of the Invention

The present invention relates to a magnetic retaining device, and more particularly to a magnetic retaining device for retaining or securing the tool members to the driving tools.

2. Description of the Prior Art

Typical driving tools may include a driving shank rotatably secured to a handle, and a ratchet control device provided and disposed between the handle and the driving shank for controlling the rotational directions of the driving shank relative to the handle. U.S. Pat. No. 6,058,812 to Casel et al. discloses one of the typical driving tools having a ratchet control device provided therein. However, the driving shank may not be extended to different lengths for attracting or for driving the tool members in the deep grooves of the machines or objects.

U.S. Pat. No. 4,876,929 to Kozak discloses a portable screw driver having a flexible extension shaft extendible outward of the screw driver for attracting or for driving the tool members in the deep grooves of the machines or objects. The screw driver includes a retaining ball for retaining and securing the tool members to the screw driver. However, the screw driver has to provide a groove formed therein for receiving the retaining ball.

U.S. Pat. No. 5,732,606 to Chiang discloses another extendible screw driver having a flexible extension shaft extendible outward of the screw driver for attracting or for driving the tool members in the deep grooves of the machines or objects. The screw driver includes a magnet or a magnetic member for retaining and securing the tool members to the screw driver. However, the magnet or the magnetic member is normally deeply engaged in the driving shank and may not be extended outward of the driving shank in order to secure the tool members to the driving tools. The present invention has arisen to mitigate and/or obviate the afore-described disadvantages of the conventional magnetic retaining devices.

SUMMARY OF THE INVENTION

The primary objective of the present invention is to provide a magnetic retaining device for retaining or securing the tool members to the driving tools.

The other objective of the present invention is to provide a magnetic retaining device including a magnet or a magnetic member partially extendible outward of the driving shank for retaining or securing the tool members to the driving tools.

In accordance with one aspect of the invention, there is provided an magnetic retaining device comprising a driving shank including a first end, a barrel secured to the first end of the driving shank, and including an orifice formed therein, a pole slidably received in the orifice of the barrel, and including a first end extendible outward of the barrel, and including a second end received in the barrel, a magnetic member secured to the first end of the pole, and means for limiting a movement of the pole relative to the barrel. The pole and thus the magnetic member may thus be moved relative to the barrel and may be moved inward and outward of the barrel.

The barrel includes a middle portion having a peripheral bulge extended radially inward for defining the orifice therein. The limiting means includes a retaining ring secured to the second end of the pole, for engaging with the peripheral bulge and for limiting the movement of the pole relative to the barrel.

The pole includes a cavity formed in the first end thereof for receiving the magnetic member. The pole includes an enlarged head formed on the first end thereof, and the enlarged head having the cavity formed therein for receiving the magnetic member.

A tube may further be provided, and a flexible extension shaft may be secured to the driving shank and slidably received in the tube and extendible inward and outward of the tube. The barrel may also be directly secured to the flexible extension shaft, instead of being secured to the driving shank.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
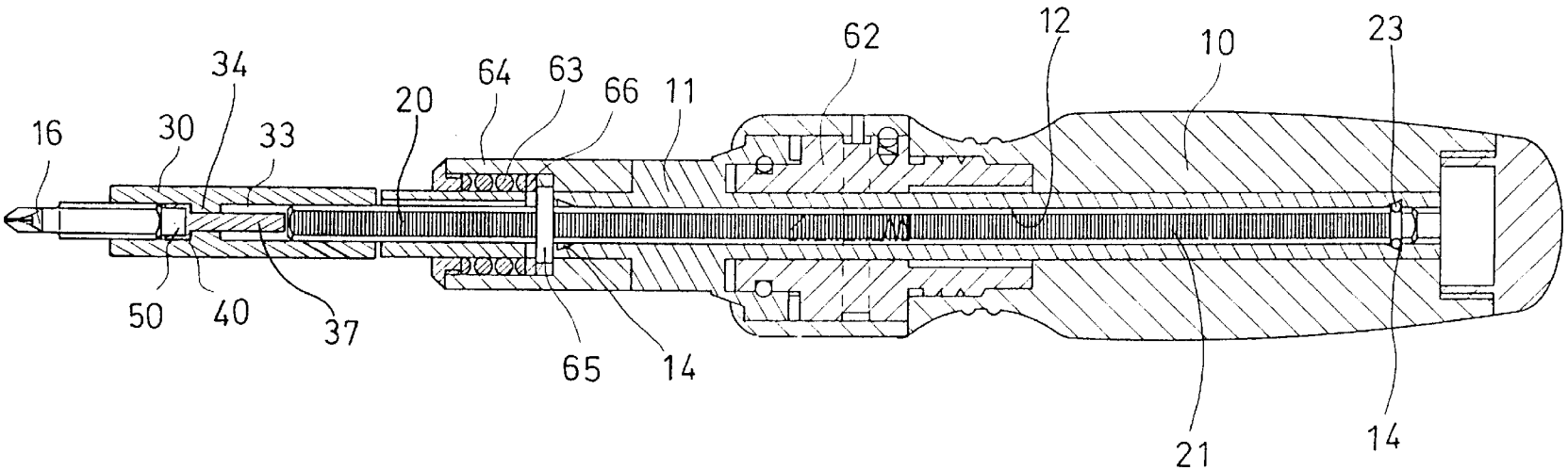
FIG. 1 is a cross sectional view of a magnetic retaining device in accordance with the present invention.

Referring to the drawings, and initially to FIG. 1, a magnetic retaining device in accordance with the present invention comprises a handle 10, a tube 11 including one end secured in the handle 10 and the other end extended outward of the handle 10. The tube 11 includes a bore 12 formed therein, and includes two annular recesses 14 formed in the ends thereof respectively. The tube 11 may be solidly secured in the handle 10 (FIG. 2), or may be rotatably secured to the handle 10 with a typical ratchet control device 62 as shown in FIG. 1.

One example of the typical ratchet control devices is disclosed in U.S. Pat. No. 6,058,812 to Casel et al. for controlling the driving direction of the handle to the driving shank, which is taken as a reference for the present invention. Similarly, various kinds of typical ratchet control devices may be provided for controlling the rotational movements or the driving directions of the handle to the driving shank.

A driving shank 20 is secured on one end, such as on the outer end of a flexible extension shaft 21 which is slidably received in the bore 12 of the tube 11, and which is extendible outward of the screw driver for attracting or for driving the tool members in the deep grooves of the machines or objects. A retaining ring 23 is secured to the inner end of the flexible extension shaft 21 and engageable with either of the annular recesses 14 of the tube 11, for retaining the flexible extension shaft 21 to the tube 11 at the inward receiving position when the retaining ring 23 is engaged with the inner or the rear annular recess 14 (FIG. 1), or the outward working position when the retaining ring 23 is engaged with the outer or the front annular recess 14 of the tube 11.

Figure 2:
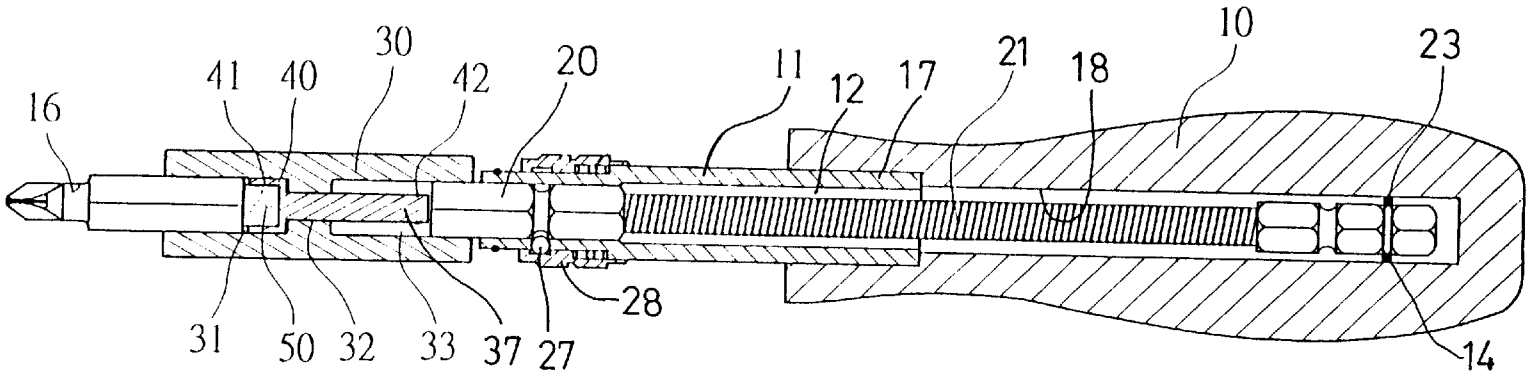
FIG. 2 is a cross sectional view similar to FIG. 1, illustrating the other arrangement for the magnetic retaining device.
Figure 3:
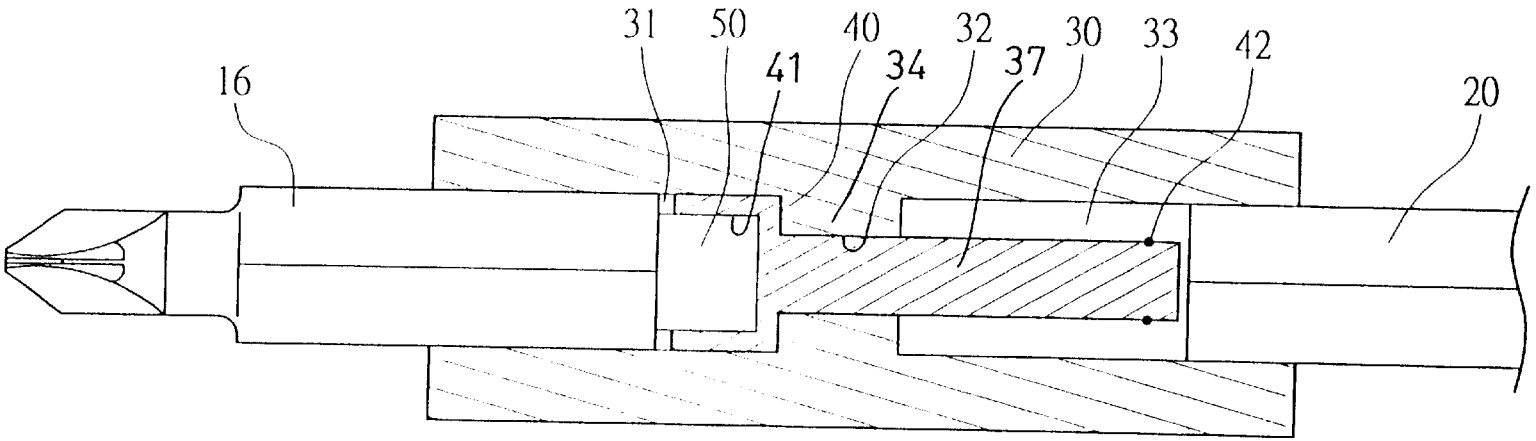
FIG. 3 is an enlarged partial cross sectional view of the magnetic retaining device.
Figure 4:
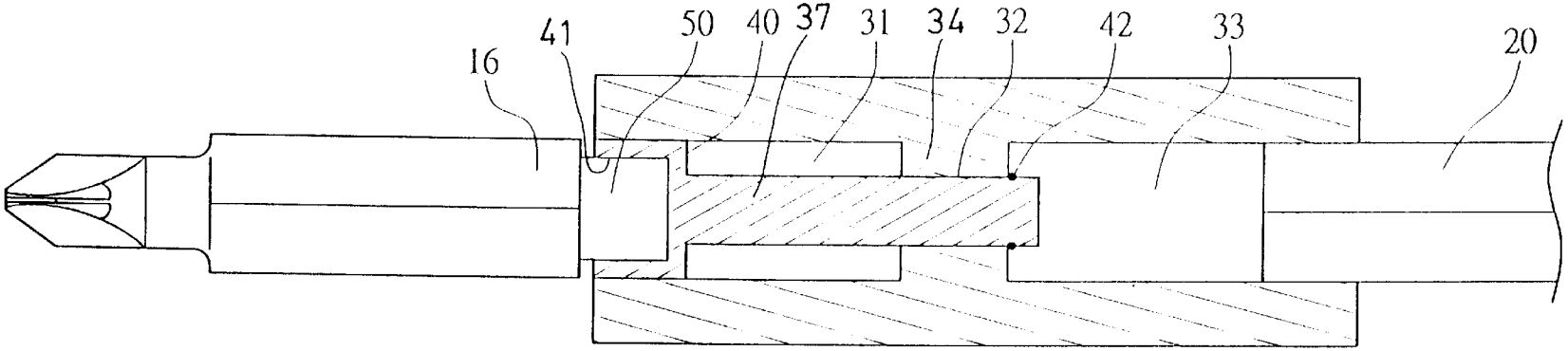
FIGS. 4, 5 are enlarged partial cross sectional views similar to FIG. 3, illustrating the operation of the magnetic retaining device.
Figure 5:
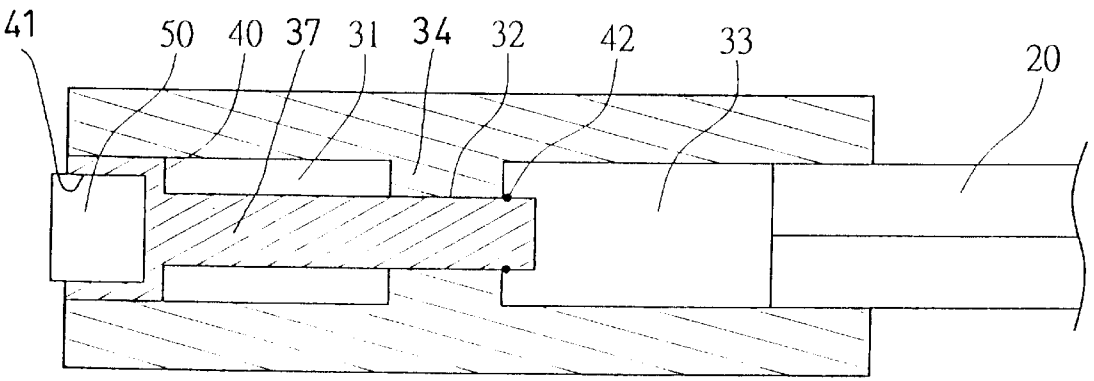

Alternatively, as shown in FIG. 2, the inner end or the rear end 17 of the tube 11 may be engaged in the front portion of the handle 10, or may be engaged in the front portion of the aperture 18 of the handle 10. In addition, the inner end or the rear end 17 of the tube 11 may be slightly engaged inward of the aperture 18 of the handle 10, for engaging with the retaining ring 23, and for retaining the flexible extension shaft 21 to the tube 11 at the outward working position when the retaining ring 23 is engaged with the rear end 17 of the tube 11.

As also shown in FIG. 1, a sleeve 64 is further provided and rotatably engaged onto the front end of the tube 11, a rod 65 is secured to the sleeve 64 and is slidably secured in the side portion of the tube 11 and engaged with the side portion of the flexible extension shaft 21. A washer 66 is engaged in the sleeve 64 and engaged with the rod 65. A spring 63 is received in the sleeve 64 and engaged with the washer 66 for biasing the washer 66 and thus the rod 65 to engage with the flexible extension shaft 21, in order to further securing the flexible extension shaft 21 to the tube 11.

Alternatively, as shown in FIG. 2, a ball 27 may further be provided and slidably engaged in the front end or the outer end of the tube 11, and a spring biased control ferrule 28 may further be provided and slidably engaged onto the front end of the tube 11 and engageable with the ball 27, for forcing the ball 27 inward the bore 12 of the tube 11 and for forcing the ball 27 to engage with the driving shank 20 and thus to selectively secure the driving shank 20 to the tube 11.

A barrel 30 is further provided and secured to the is outer end of the driving shank 20 or directly secured to the outer end of the flexible extension shaft 21, with such as a welding process, or with fasteners, or is adhesive materials, for allowing the driving shank 20 and/or the flexible extension shaft 21 to be rotated in concert with the barrel 30. As shown in FIGS. 3–7, the barrel 30 includes a peripheral bulge 34 extended radially inward from the middle portion thereof for forming an orifice 32 in the peripheral bulge 34 and for forming two chambers 31, 33 formed in the ends of the barrel 30 and communicating with the orifice 32 of the barrel 30. The orifice 32 of the barrel 30 includes an inner diameter smaller than that of the chambers 31, 33 of the barrel 30.

A pole 37 is slidably engaged through the orifice 32 of the barrel 30. A retaining ring 42 is secured to one end, such as the inner end of the pole 37, for engaging with the peripheral bulge 34 (FIGS. 4, 5, 7), and for limiting the relative sliding movement between the pole 37 and the barrel 30. The outer end of the driving shank 20 or of the flexible extension shaft 21 is partially engaged into the chamber 33 of the barrel 30 and is solidly secured to the barrel 30 for enclosing or blocking the chamber 33 of the barrel 30.

Figure 6:
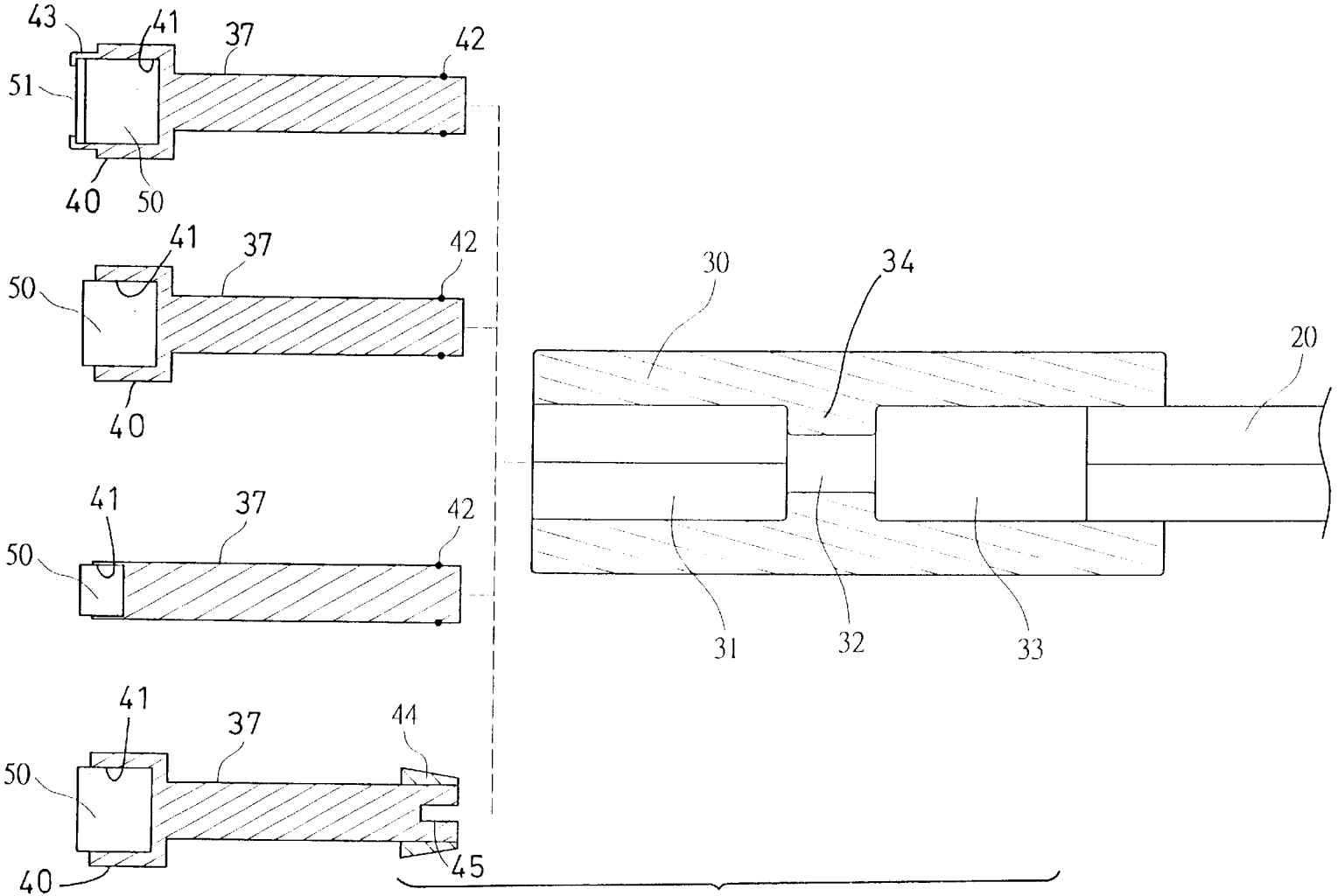
FIG. 6 is an enlarged partial cross sectional and partial exploded view of the magnetic retaining device.

Alternatively, as shown in FIG. 6, the pole 37 may include one or more latches 44 and one or more slits 45 formed in the inner end thereof, for allowing the inner end of the pole 37 to be forced and moved through the orifice 32 of the barrel 30 and for allowing the latches 44 to be engaged with the peripheral bulge 34 in order to limit the relative sliding movement between the pole 37 and the barrel 30. The other fasteners or catches (not shown) may further be provided and secured to the inner end of the pole 37 for engaging with the peripheral bulge 34 and for limiting the relative sliding movement between the pole 37 and the barrel 30.

The pole 37 includes the other end, such as the outer end having a cavity 41 formed therein for receiving a magnet or a magnetic member 50 therein (FIG. 6), or may include an enlarged head 40 formed or provided on the other end thereof and slidably received in the chamber 31 of the barrel 30, and having the cavity 41 formed in the head 40 for receiving and retaining or securing the magnet or the magnetic member 50 in the cavity 41 of the head 40.

A shield 51 (FIG. 6) may further be provided and engaged onto the magnetic member 50, and the head 40 may include a peripheral flange 43 for engaging with the shield 51 and for solidly retaining the shield 51 and the magnetic member 50 to the head 40. The magnet or the magnetic member 50 and/or the head 40 may be partially extended outward of the chamber 31 of the barrel 30, for attracting or retaining the tool members to the barrel 30 and thus to the driving shank 20 and the flexible extension shaft 21.

Figure 7:
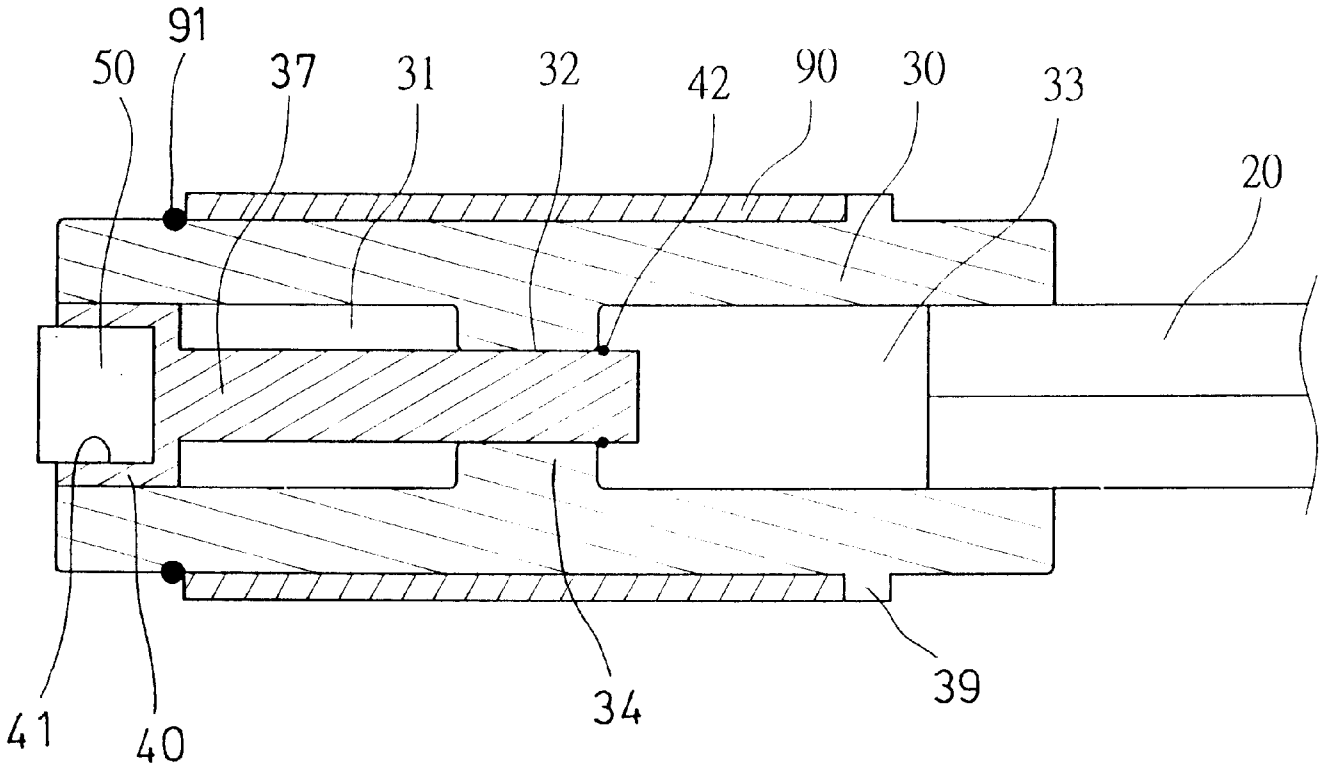
FIG. 7 is an enlarged partial cross sectional view similar to FIGS. 3–5, illustrating the other embodiment of the magnetic retaining device.

Referring next to FIG. 7, a ferrule 90 may further be provided and rotatably engaged onto the barrel 30. The barrel 30 includes a peripheral rib 39 extended radially outward from one end of the barrel 30 for engaging with the ferrule 90. A retaining ring 91 may further be provided and engaged with the other end of the barrel 30 and engaged with the ferrule 90, for rotatably securing the ferrule 90 on the barrel 30.

Figure 8:
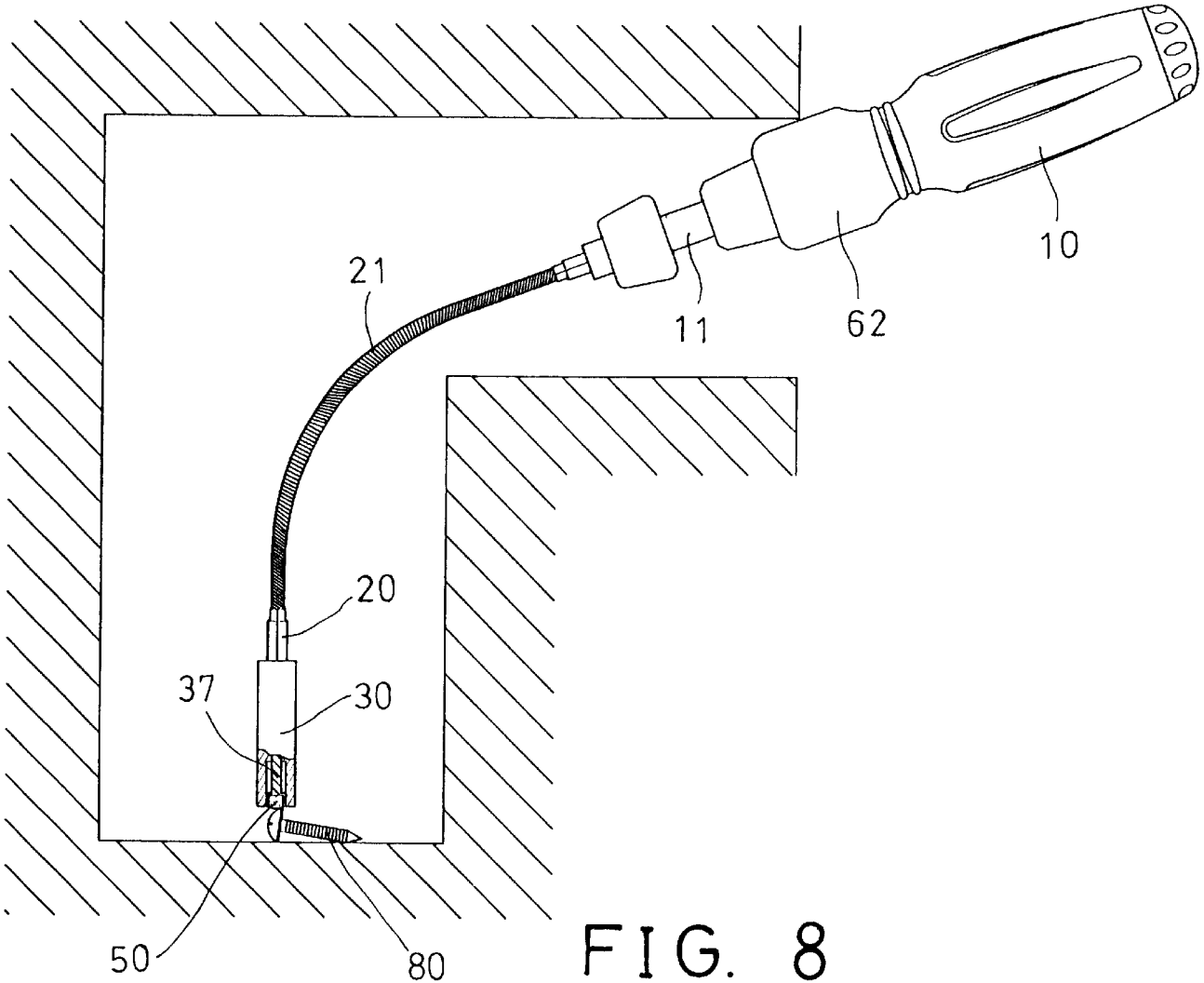
FIG. 8 is a schematic or cross sectional view, illustrating the operation of the magnetic retaining device.

In operation, as shown in FIG. 8, the flexible extension shaft 21 and the driving shank 20 may be pulled or extended outward of the tube 11 for attracting and/or for driving the tool members 80 in the deep grooves of the machines or objects. In addition, the pole 37 and/or the magnetic member 50 may further be slided or extended outward of the barrel 30 for further attracting and/or for driving the tool members 80 in the deep grooves of the machines or objects.

As shown in FIGS. 1 and 2, the fasteners or the tool extensions or the tool bits 16 may be engaged into the chamber 31 of the barrel 30, and may thus be rotated or driven by the barrel 30 and the driving shank 20 or the flexible extension shaft 21. The pole 37, at this moment, may be engaged into the chambers 31, 33 of the barrel 30. The pole 37 and the magnetic member 50 may be pulled outward of the barrel 30 when the fasteners or the tool extensions or the tool bits 16 are moved or pulled outward of the barrel 30.

Accordingly, the magnetic retaining device may be used for retaining or securing the tool members to the driving tools, or may include a magnet or a magnetic member partially extendible outward of the driving shank for retaining or securing the tool members to the driving tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetic retaining device comprising:

a driving shank including a first end, a barrel secured to said first end of said driving shank, and including an orifice formed therein, a pole slidably received in said orifice of said barrel, and including a first end extendible outward of said barrel, said first end of said pole including an enlarged head formed thereon and having a cavity formed in said enlarged head of said pole, and said pole including a second end received in said barrel, a magnetic member secured in said cavity of said pole, for attracting tool members to said pole and for allowing said pole to move the tool members relative to said barrel with said magnetic member, and means for limiting a movement of said pole relative to said barrel.

2. The magnetic retaining device according to claim 1, wherein said barrel includes a middle portion having a peripheral bulge extended radially inward therefrom for defining said orifice therein.

3. The magnetic retaining device according to claim 2, wherein said limiting means includes a retaining ring secured to said second end of said pole, for engaging with said peripheral bulge of said barrel and for limiting the movement of said pole relative to said barrel.

4. The magnetic retaining device according to claim 1 further comprising a tube, a flexible extension shaft secured to said driving shank and slidably received in said tube and extendible inward and outward of said tube.

* * * * *